United States Patent [19]

Dickey

[11] Patent Number: 4,942,969

[45] Date of Patent: Jul. 24, 1990

[54] VAPOR PRESSURE RETENTION APPARATUS

[76] Inventor: John A. Dickey, 516 Addison Ave. NE., Palm Bay, Fla. 32907

[21] Appl. No.: 278,781

[22] Filed: Dec. 2, 1988

[51] Int. Cl.[5] ..... B65D 23/10

[52] U.S. Cl. ..... 215/100 R; 215/100 A; 220/85 D; 220/94 B

[58] Field of Search ..... 215/100 R, 100 A, 101; 220/85 D, 94 B, DIG. 17

[56] References Cited

U.S. PATENT DOCUMENTS

| | | | |
|---|---|---|---|
| 2,196,529 | 4/1940 | Jenkins | 215/100 A |
| 2,812,968 | 11/1957 | Sevener | 215/100 A |
| 3,088,767 | 5/1963 | Deal | 215/100 A X |
| 3,177,025 | 4/1965 | Short | 215/100 A X |
| 4,116,374 | 9/1978 | Garello | 215/100 A X |
| 4,747,495 | 5/1988 | Rendine | 215/101 |

FOREIGN PATENT DOCUMENTS

| | | | |
|---|---|---|---|
| 1433209 | 4/1976 | United Kingdom | 215/100 A |
| 2178001 | 6/1986 | United Kingdom . | |

*Primary Examiner*—Stephen Marcus
*Assistant Examiner*—Christine A. Peterson

[57] ABSTRACT

A vapor pressure retention apparatus for applying pressure to the outside surface of a container holding a carbonated beverage. Application of the pressure increases the vapor pressure of the air above the carbonated beverage and thus allows less of the carbon dioxide dissolved in the beverage to escape into the air.

8 Claims, 3 Drawing Sheets

VAPOR PRESSURE RETENTION APPARATUS

FIELD OF THE INVENTION

This invention in general pertains to maintaining the partial pressure of a gas dissolved in a liquid in a sealed container after opening and reclosing, and pertains specifically to maintaining the pressure of the carbon dioxide dissolved in soda pop in the flexible resealable plastic bottles.

BACKGROUND OF THE INVENTION

Since the advent of the larger size resealable plastic 1 liter and 2 liter bottles the problem has existed that if the pop is not all used and the bottle is resealed, the carbon dioxide in the liquid comes out of solution and builds pressure in the bottle until the partial pressure of the remaining dissolved gas is equal to the pressure of the gas in the empty space in the bottle. Further, each time the bottle is reopened the gas pressure that has built up in the bottle is lost in the atmosphere and must rebuild after reclosure by further loss of dissolved gas. As a 2 liter bottle holds 8 to 10 medium sized glasses of liquid, the bottle may need resealed up to 10 times or once for each glass poured, thereby losing almost all of the dissolved carbon dioxide fizz by the time the last glass is to be used Obviously there are ways to repressurize the bottle as it was pressurized originally, but to date there exists no very low cost approach or device for the average consumer to use to keep the pop in the bottle from going flat (i.e. loosing all the "fizz") after opening and reopening the bottle.

SUMMARY OF THE INVENTION

In accordance with the present invention there exists a new device with which to preserve a significant portion of the carbon dioxide pressure in the soda pop in the flexible plastic resealable bottles.

The basic device consists of 2 pieces as shown in FIG. 1; a backup pressure piece with pivot pins, and a handle piece that provides leverage and clamping. The basic principle the device uses is simply to squeeze the bottle after the cap has been replaced and resealed thereby raising the internal vapor pressure of the carbon dioxide immediately after closing the bottle The increased internal vapor pressure means that less carbon dioxide will have to come out of solution to bring the vapor pressure of the gas and that dissolved in the liquid into equilibrium. Another way to look at this is to recognize that when the bottle is squeezed, there exists less volume of gas inside thereby requiring less carbon dioxide to come from the soda into the air to bring the air pressure up to that of the carbon dioxide still dissolved in the soda.

BRIEF DESCRIPTION OF THE DRAWINGS

The present invention may be better understood and the further advantages and uses more apparent when considered in view of the Description of the Preferred Embodiments below and the following figures in which.

DESCRIPTION OF THE PREFERRED EMBODIMENTS

Figure 1:
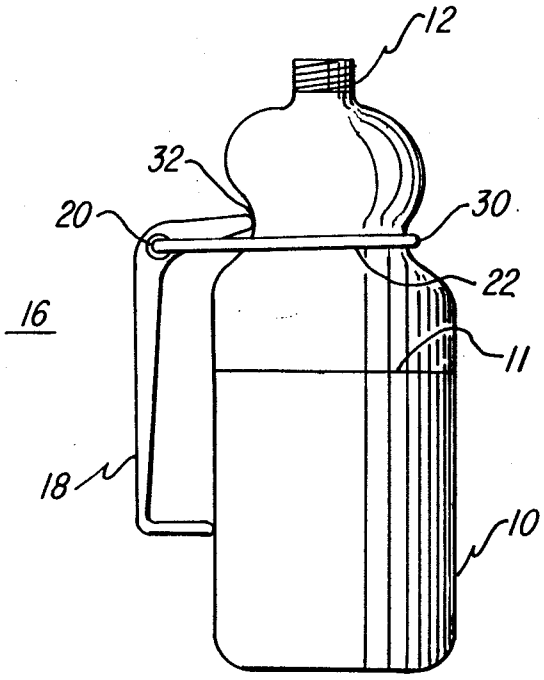
FIG. 1 shows a vapor pressure retention apparatus, constructed according to the teachings of the present invention, in place on a plastic bottle.

FIG. 1 shows a plastic soda bottle 10, such as the well-known two liter soda bottles, including a cap 12. The bottle 10 is partially filled with soda, or any other carbonated liquid. An exemplary liquid level is indicated by the horizontal line 11.

Figure 3:
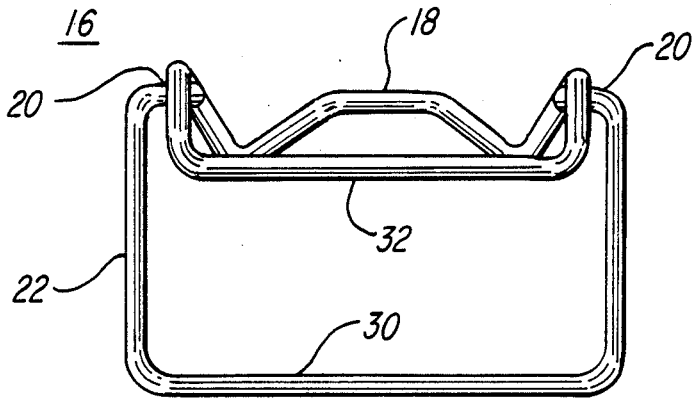
FIG. 3 shows the top view of the vapor pressure retention apparatus in place on a plastic bottle with the bottle removed from the picture for clarity.

The vapor pressure retention apparatus 16 includes a handle 18 attached at pivot joints 20 (one on each side of the handle 18) to a backup piece 22. As is well-known by those skilled in the art, the pivot joint 20 can be constructed in any one of many ways. In the embodiment where the vapor pressure retention apparatus 16 is constructed of a metalic rod, the pivot joint 20 can be formed by making a loop in the handle rod at that point so as to form a hole thru which the backup piece 22 can be inserted. This is clearly illustrated in FIG. 3.

Figure 2:
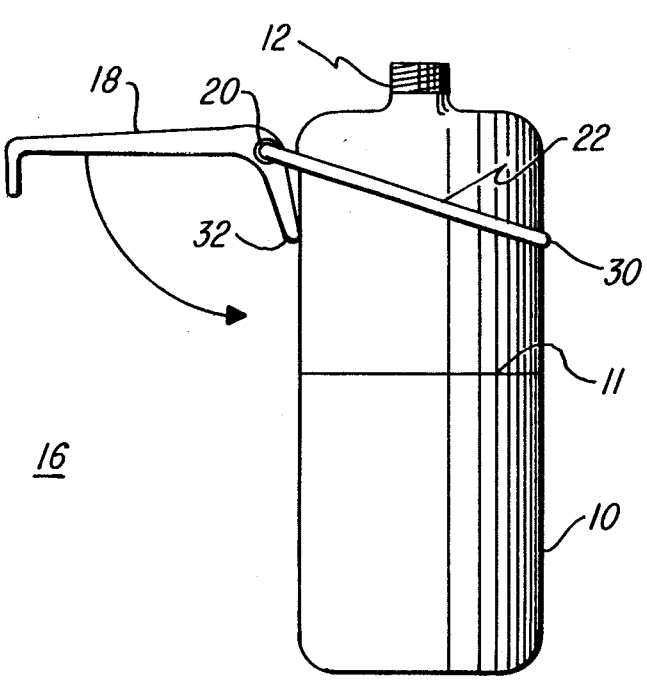
FIG. 2 illustrates the manner in which the vapor pressure retention apparatus is placed on the plastic bottle.

The vapor pressure retention apparatus 16 is used by placing it over a freshly resealed bottle, as shown in FIG. 2, and rotating the handle 18 downward about 140 degrees until it stops against the bottom area of the bottle 10 as shown in FIG. 1. During this process the bottle 10 is squeezed between the pressure bar 30 of the backup piece 22 and the pressure bar 32 of the handle 18 thereby immediately increasing the pressure inside the bottle 10. It is important that the bottle 10 be tightly capped and the vapor pressure retention apparatus applied to the bottle before gas pressure begins to build up inside the bottle 10.

The vapor pressure retention apparatus 16 stays in place after being attached to the bottle 10 because the angle between the handle 18 and the pressure bar 32 is more than 90 degrees. This creates an 'over-center' clamp where the vector force on the pivot points 20 after the vapor pressure retention apparatus 16 has been attached to the bottle 10 lies between the handle 18 and the pressure bar 32.

The vapor pressure retention apparatus 16 keeps more of the carbon dioxide in solution because the pressure applied to the bottle 10 significantly reduces the amount of carbon dioxide that must come out of solution to balance the partial pressure of the remaining dissolved carbon dioxide with that of the undissolved gas. In other words the vapor pressure retention apparatus reduces the amount of gas that must come out of solution for the system to reach equilibrium.

To open the bottle 10, the vapor pressure retention apparatus 16 should be removed before removing the cap from the bottle and releasing the internal pressure. The vapor pressure retention apparatus is removed by rotating the handle 18 upward. This should be accomplished with as little jarring of the bottle 10 as possible. Removing the apparatus 16 first allows the pressure inside the bottle 10 to restore the original shape of the bottle 10 so that on the next reclosing as much trapped carbon dioxide as possible will be retained inside the bottle 10. This will provide the highest pressure inside the bottle 10 after closing and thereby provide the most effect reduction in the loss of carbon dioxide from the liquid. After removing the apparatus 16, remove the cap, use the soda, and reseal and reapply the apparatus 16 immediately. The time when the bottle 10 is open to the normal air pressure is the time of highest loss rate of dissolved carbon dioxide.

Another embodiment of the vapor pressure retention apparatus 16 that will improve it's effectiveness is to add an attachment to the backup piece 22 that will provide the ability for the user to select how close the pressure bars 30 and 32 wll come together or in other words to select how tight the apparatus 16 will squeeze the bottle 10. This is very useful since the bottle 10 needs to be squeezed more when it is almost empty than when it is nearly full to maintain the same pressure inside. This is due to the fact that air inside the bottle 10 is very compressible but the liquid is not and as the ratio of air to liquid is increased as the bottle 10 is emptied more volume must be squeezed out of the internal volume of the bottle 10 to achieve the same internal pressure. Thus when the bottle 10 is nearly full the small amount of air inside the bottle 10 becomes highly compressed when the vapor pressure retention device displaces internal volume of the bottle 10, but when the bottle is nearly empty the volume the apparatus 16 displaces does not create nearly as much pressure inside the bottle 10. Nevertheless the basic embodiment of the vapor pressure retention device 16 does provide a considerable improvement in carbon dioxide fizz retention throughout the use of the entire bottle of liquid.

Figure 4A:
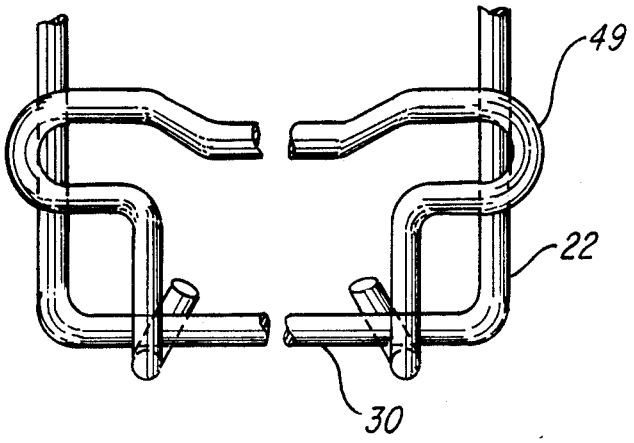
FIGS. 4A and 4B show two views of a portion of an alternative embodiment utilizing an additional piece that can be rotated into place to increase the pressure inside the bottle when the bottle is not very full.
Figure 4B:
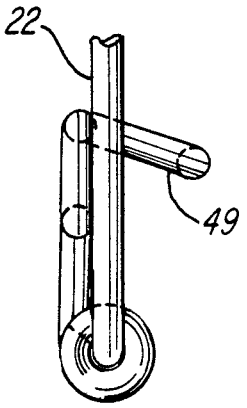
Figure 6A:
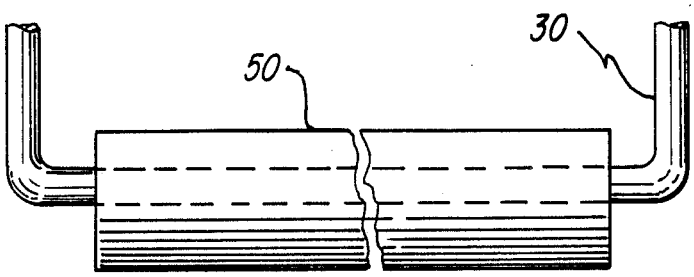
FIGS. 6A and 6B show two views of an alternative embodiment utilizing an asymetrically shaped rotating piece that can be rotated before applying the apparatus to the bottle so the amount of pressure can be adjusted as needed to optimize the effectiveness of the apparatus as the bottle contents are emptied.
Figure 6B:
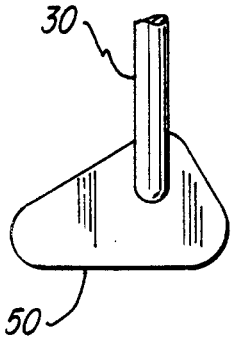
Figure 5:
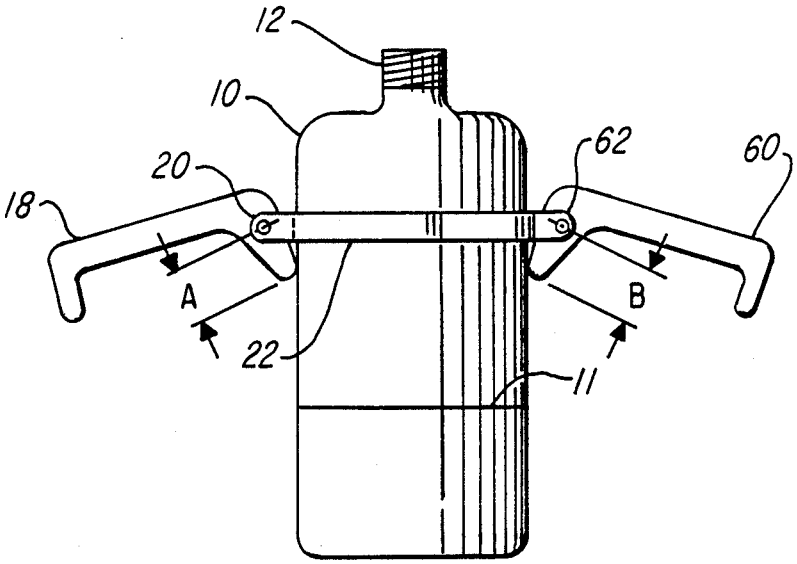
FIG. 5 shows an alternative embodiment utilizing two handle pieces 18 and 60 which may have pressure bars of different lengths 'A' and 'B' in order to apply different amounts of pressure to the bottle as the contents are emptied by using the different combinations of handle 18 or handle 60 or both 18 and 60.

Some example approaches to this optional addition are:

(1.) A swing arm 49 that shortens the pivot distance if in place. See FIGS. 4A and 4B. The swing arm is attached to the pressure bar 30 and can be swung into position between the pressure bar 30 and the pressure bar 32 as shown in FIGS. 4A and 4B when the soda level in the bottle is low. When not needed, the swing arm can be pivoted to the outside of the pressure bar 30. (2.) A second lever handle 60 in place of or in addition to the pressure bar 30. See FIG. 5 where the handle 60 is shown attached to a connecting member 61 at pivot points 62 (one on each side of the handle 60). (3.) A shaped bar or rod 66 on the pressure bar 30 with the hole in it off-center so that rotating the bar about the pressure bar 30 changes the effective distance between the pressure bars 30 and 32. See FIGS. 6A and 6B.

Another embodiment of the vapor pressure retention apparatus 16 that will provide improved effectiveness with no adjustment but will complicate the design and manufacture would be to provide a spring action between the pressure bars 30 and 32 so that they would tend to provide a more constant pressure at different stages of emptying the contents of the bottle 10. For example, the connecting member 22 could be replaced by a spring.

While I have shown and described embodiments in accordance with the present invention, it is understood that the same is not limited to these implementations due to the numerous changes and modifications known to a person skilled in the art as has been previously herein described, and I therefore do no wish to be limited to the details shown and described herein but intend to cover all such changes and modifications as are obvious to one of ordinary skill in the art.

What is claimed is:

1. A pressurizing apparatus for placing around a flexible container holding a carbonated beverage, comprising:

a member for fitting loosely around the container, wherein said member includes a substantially straight portion and a first and a second free end spaced apart from said straight portion and located on opposite sides of said loosely fitting member;

a lever arm having first and second pivot points pivotably coupled to said first and said second free ends, respectively, includes a compression member substantially parallel to said straight portion and to a line connecting said first and second pivot points;

wherein as said lever arm is pivoted with respect to said loosely fitting member, said compression member moves toward the plane of said loosely fitting member and closer to said straight portion until said compression member crosses the plane of said loosely fitting member thus latching said compression member in that position so as to squeeze the container between said compression member and said straight portion, thereby reducing the amount of carbon dioxide that comes out of solution from the beverage into the air inside of the container.

2. A pressurizing apparatus for pressurizing a container holding a carbonated beverage, comprising:

a member having a general U-shape for placement around the container, wherein said member includes first and second leg members and a first pressure piece connecting the first end of said first and said second leg members;

lever arm having a grasping portion, a first and a second oppositely disposed pivot means, and a second pressure piece disposed in parallel orientation to said first pressure piece and to a line connecting said first and said second pivot means, wherein the second end of said first leg member is pivotably attached to said first pivot means, and wherein the second end of said second leg member is pivotably attached to said second pivot means, wherein said pressurizing apparatus is mounted on the container is such a way that the container fits within the general U-shaped opening of said U-shaped member, wherein downward rotation of said grasping portion about said first and said second pivot means urges said second pressure piece against the container to compress the container between said first and said second pressure pieces, whereby reducing the amount of carbon dioxide that comes out of solution from the beverage into the air inside the container;

and wherein downward rotation also urges said second pressure piece into an over-center position above said first pressure piece to latch the pressurizing apparatus in this position.

3. The pressurizing of claim 2 including a swing arm pivotably attached to the first pressure piece, wherein said swing arm can be pivoted to a position within the U-shaped opening of the U-shaped member, thereby reducing the effective distance between the first and the second pressure pieces when the pressurizing apparatus is placed on the container.

4. The pressurizing apparatus of claim 2 including an irregularly shaped bar having an off-center bore extending the length thereof, wherein said first pressure piece is fitted within the off-center bore, and wherein said shaped bar is rotated around the first pressure piece to decrease the effective distance between the first and the second pressure pieces when the pressurizing apparatus is placed on the container.

5. A pressurizing apparatus for pressurizing a container holding a carbonated beverage, comprising:

a first lever arm means having first and second pivot means on opposite sides thereof;

a second lever arm means having third and fourth pivot means on opposite sides thereof;

a first connecting member pivotably attached to said first and said third pivot means;

a second connecting member pivotably attached to said second and said fourth pivot means and oriented substantially parallel to said first connecting member;

wherein said first lever arm means further includes a first pressure means extending from said first lever arm means toward said second lever arm means and substantially parallel to a line passing through said first and said second pivot means;

and wherein said second lever arm means further includes a second pressure means extending from said second lever arm means toward said first lever arm means and substantially parallel to a line passing through said third and fourth pivot means;

wherein said pressurizing apparatus is placed around the container in such a way that the container fits between said first and said second lever arm means and said first and said second connecting members;

and wherein downward rotation of said first lever arm means about said first and said second pivot means, and downward rotation of said second lever arm means about said third and said fourth pivot means urges said first and second pressure means against the container to compress the container thereby reducing the amount of carbon dioxide that comes out of solution from the beverage into the air inside the container.

6. The pressurizing apparatus of claim 1 wherein the loosely fitting member includes a substantially U-shaped piece, and wherein the straight portion forms the leg opposite the free ends of said U-shaped piece, and wherein each free end of said U-shaped piece is pivotably coupled to one of the first and the second pivot points.

7. The pressurizing apparatus of claim 1 wherein the compression member includes a raised portion spaced apart from the plane of the lever arm, and wherein said raised portion forms an angle greater than 90 degrees with the plane of the lever arm such that when the lever arm is pivoted with respect to the loosely fitting member said raised portion is brought closer to the straight portion and latched in that position by the over-center orientation of said raised portion with respect to the loosely fitting member.

8. The pressurizing apparatus of claim 1 wherein the compression member is a cam surface having an axis formed by a line connecting the first and the second pivot points, and wherein said cam surface forms an angle greater than 90 degrees with the plane of the lever arm such that when the lever arm is pivoted with respect to the loosely fitting member said cam surface is positioned closer to the straight portion and latched in that position by the over-center orientation of said cam surface with respect to the loosely fitting member.

* * * * *